US011187076B2

(12) United States Patent
Han et al.

(10) Patent No.: US 11,187,076 B2
(45) Date of Patent: Nov. 30, 2021

(54) CENTRAL STORAGE UNIT FOR A MEASURING-WHILE-DRILLING ASSEMBLY FOR AN OIL DRILLING SYSTEM

(71) Applicant: China Petroleum & Chemical Corporation, Beijing (CN)

(72) Inventors: Jun Han, Houston, TX (US); Sheng Zhan, Houston, TX (US); Fengtao Hu, Houston, TX (US); Jinhai Zhao, Houston, TX (US)

(73) Assignee: China Petroleum & Chemical Corporation, Beijing (CN)

( * ) Notice: Subject to any disclaimer, the term of this patent is extended or adjusted under 35 U.S.C. 154(b) by 211 days.

(21) Appl. No.: 16/576,072

(22) Filed: Sep. 19, 2019

(65) Prior Publication Data

US 2021/0087924 A1 Mar. 25, 2021

(51) Int. Cl.

| | |
|---|---|
| ***E21B 47/12*** | (2012.01) |
| ***E21B 41/00*** | (2006.01) |
| ***E21B 44/00*** | (2006.01) |

(52) U.S. Cl.

CPC ..... *E21B 47/12* (2013.01); *E21B 41/00* (2013.01); *E21B 44/00* (2013.01)

(58) Field of Classification Search

None

See application file for complete search history.

(56) References Cited

U.S. PATENT DOCUMENTS

2007/0168132 A1* 7/2007 Yu ..... E21B 47/12 702/6
2011/0048700 A1* 3/2011 van Zuilekom ..... G01N 9/00 166/250.01
2011/0169656 A1* 7/2011 Khan ..... G01V 11/002 340/854.6
2018/0371901 A1* 12/2018 Lakings ..... E21B 7/06
2019/0100966 A1* 4/2019 Parkin ..... E21B 34/066

FOREIGN PATENT DOCUMENTS

GB 2425792 A * 11/2006 ..... E21B 47/12

* cited by examiner

*Primary Examiner* — Lina M Cordero
(74) *Attorney, Agent, or Firm* — Novick, Kim & Lee, PLLC; Allen Xue

(57) ABSTRACT

An apparatus for collecting and storing sensor data for an oil drilling system is disclosed. The apparatus for collecting and storing sensor data may include a drill string including a bottom whole assembly which includes a drill bit and a measurement-while-drilling (MWD) assembly; a master board including a master board micro controller unit (MCU) in the MWD assembly; a plurality of sensor boards to sense and collect sensor data; a removable central storage unit, including a central storage unit MCU in the MWD assembly, to store sensor data collected by the plurality of sensor boards; and an internal bus coupled to the master board, the plurality of sensor boards, and the removable central storage unit to carry sensor data from the plurality of sensor boards to the removable central storage unit for storage by the removable central storage unit.

16 Claims, 7 Drawing Sheets

CENTRAL STORAGE UNIT FOR A MEASURING-WHILE-DRILLING ASSEMBLY FOR AN OIL DRILLING SYSTEM

TECHNICAL FIELD

The present disclosure provides an oil drilling system including a drill string and a bottom whole assembly. The bottom whole assembly may include a central storage unit (CSU) for a measurement-while-drilling (MWD) assembly for down-whole storage of sensor data from a plurality of sensors.

BACKGROUND

Logging-While-Drilling (LWD) instruments and Measurement-While-Drilling (MWD) instruments are widely used in oil and gas drilling and formation evaluation. For example, these instruments may be installed in a bottom whole assembly (BHA) of a drill string coupled to a derrick above the earth surface. The MWD instruments may be part of an MWD system (MWD assembly) in the BHA of the drill string.

However, collecting, processing, and storing large amounts of sensor data presents a challenge. For example, a master board including a master micro controller unit (MCU) is the core of the MWD system in the BHA. The master board is used to acquire sensor data on other boards through an internal bus. The master board is also used to record sensor data to an external flash memory on the master board. In order to further search, process, and retrieve the sensor data from the external flash memory, the stored (recorded) sensor data must be downloaded from the external flash memory on the master board through specific communication protocols and commands. The downloading of sensor data is very time consuming. In addition, in a traditional MWD system, external storage is mounted on the master board frequently by soldering. If the MCU on the master board, the external storage mounted on the master board, or a communication bus on the master board has been damaged or fails completely for any reason including a manufacturing defect or damage during use, the sensor data stored in the external flash memory cannot be accessed. Therefore, the sensor data would be lost.

Accordingly, there is a need for devices, apparatuses, and methods for efficiently and reliably collecting and storing sensor data at high speeds within the BHA for further analysis.

SUMMARY

This disclosure provides devices, apparatuses, and methods for efficiently and reliably collecting and storing sensor data from sensors of a drill string, so that sensor data can be retrieved for further analysis.

In an aspect of one or more embodiments, there is provided an apparatus for collecting and storing sensor data for an oil drilling system, may include a drill string including a bottom whole assembly which includes a drill bit and a measurement-while-drilling (MWD) assembly; a master board including a master board micro controller unit (MCU) in the MWD assembly; a plurality of sensor boards to sense and collect sensor data; a central storage unit, including a central storage unit MCU in the MWD assembly, to store sensor data collected by the plurality of sensor boards; and an internal bus coupled to the master board, the plurality of sensor boards, and the central storage unit to carry sensor data from the plurality of sensor boards to the central storage unit for storage by the central storage unit, wherein the central storage unit is removable from the MWD assembly.

In an aspect of one or more embodiments, the apparatus may further comprise a directional module, coupled to the internal bus, to sense and collect directional data regarding conditions and direction of the drill string.

In an aspect of one or more embodiments, the direction module may include one or more directional sensors, one or more accelerometers, one or more magnetometers, and one or more temperature sensors.

In an aspect of one or more embodiments, the master board MCU may send commands to the plurality of sensor boards to command the sensor boards to sense data.

In an aspect of one or more embodiments, the one or more sensor boards periodically output or make available sensor data on the internal bus.

In an aspect of one or more embodiments, the one or more sensor boards output or make available sensor data on the internal bus in response to a request from the central storage unit MCU or the master board MCU.

In an aspect of one or more embodiments, the central storage unit further comprises a bus adapter coupling the internal bus to the central storage unit MCU.

In an aspect of one or more embodiments, the central storage unit further comprises a secure digital (SD) card coupled to the central storage unit MCU to store the sensor data; and the SD card is removable from the central storage unit.

In an aspect of one or more embodiments, the central storage unit further comprises a SD card array coupled to the central storage unit MCU to store the sensor data; the SD card array includes a plurality of SD cards; and each SD card in the SD card array is removable.

In an aspect of one or more embodiments, each SD card is assigned one of the sensor boards; and each SD card stores sensor data from the one assigned sensor board.

In an aspect of one or more embodiments, there is provided a measurement-while-drilling (MWD) system for a drill string of an oil drilling system. The MWD system may include a master board including a master board micro controller unit (MCU); a plurality of sensor boards to sense and collect sensor data; a central storage unit, including a central storage unit MCU, to store sensor data collected by the plurality of sensor boards; and an internal bus coupled to the master board, the plurality of sensor boards, and the central storage unit to carry sensor data from the plurality of sensor boards to the central storage unit for storage by the central storage unit, wherein the central storage unit is removable from the MWD system.

In an aspect of one or more embodiments, the MWD system may further comprise a directional module, coupled to the internal bus, to sense and collect directional data regarding conditions and direction of the drill string.

In an aspect of one or more embodiments, the direction module may include one or more directional sensors, one or more accelerometers, one or more magnetometers, and one or more temperature sensors.

In an aspect of one or more embodiments, the master board MCU may send commands to the plurality of sensor boards to command the sensor boards to sense data.

In an aspect of one or more embodiments, the one or more sensor boards periodically output or make available sensor data on the internal bus.

In an aspect of one or more embodiments, one or more sensor boards output or make available sensor data on the internal bus in response to a request from the central storage unit MCU or the master board MCU.

In an aspect of one or more embodiments, the central storage unit further comprises a bus adapter coupling the internal bus to the central storage unit MCU.

In an aspect of one or more embodiments, the central storage unit further comprises a secure digital (SD) card coupled to the central storage unit MCU to store the sensor data; and the SD card is removable from the central storage unit.

In an aspect of one or more embodiments, the central storage unit further comprises a SD card array coupled to the central storage unit MCU to store the sensor data; the SD card array includes a plurality of SD cards; and each SD card in the SD card array is removable.

In an aspect of one or more embodiments, each SD card is assigned one of the sensor boards; and each SD card stores sensor data from the one assigned sensor board.

BRIEF DESCRIPTION OF THE DRAWINGS

The teachings of the present invention can be readily understood by considering the following detailed description in conjunction with the accompanying drawings.

DETAILED DESCRIPTION

Figure 1:
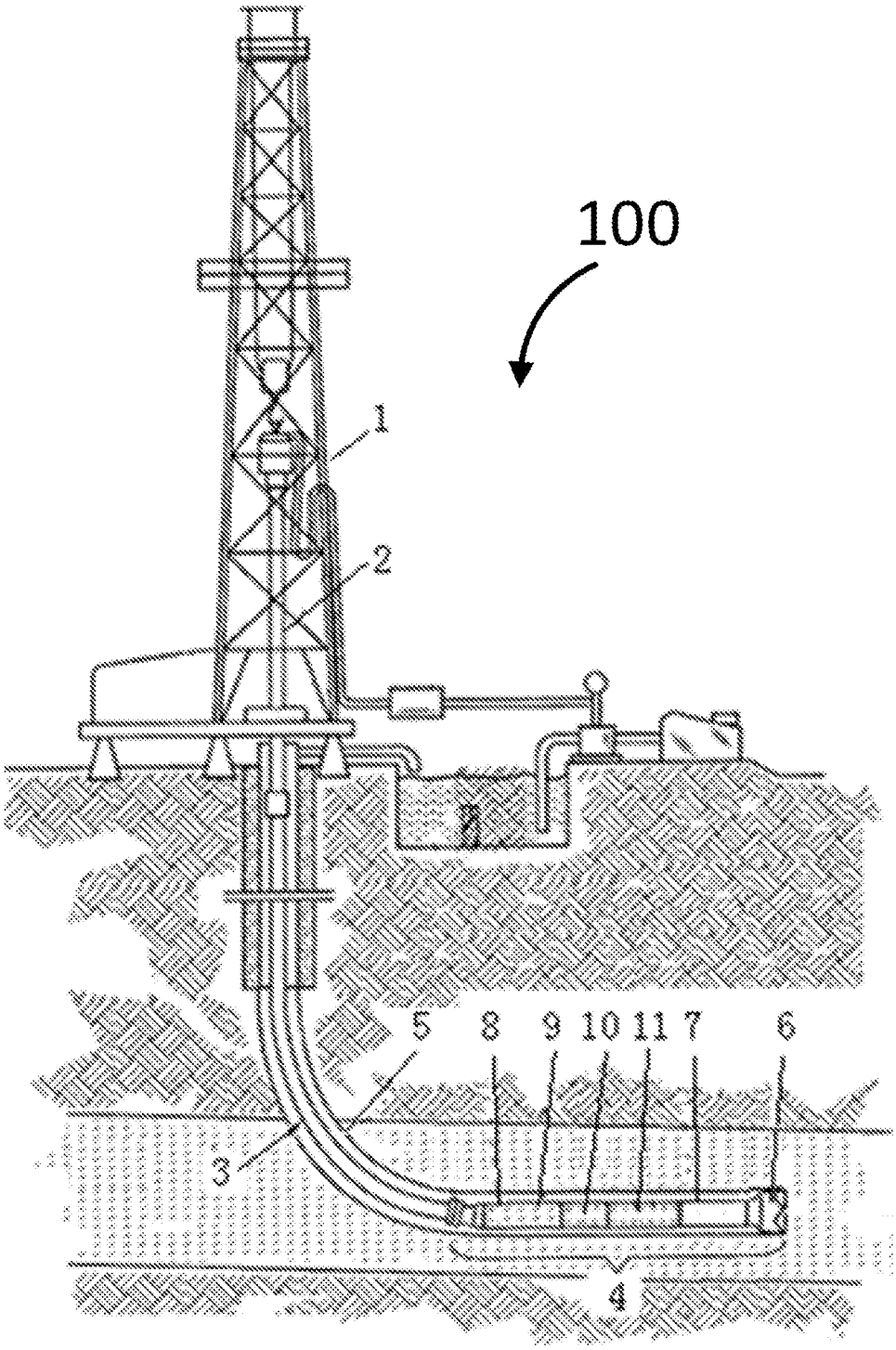
FIG. 1 is a schematic diagram showing an oil drilling system at a wellsite according to an embodiment.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the disclosure.

Oil drilling systems may include logging-while-drilling (LWD) instruments or systems which employ formation evaluation tools that measure pressure, gamma ray, resistivity, sonic, porosity and density properties of a formation, in addition to other measurements related to formations. These evaluation tools may include magnetic resonance imaging and formation testing tools which are deployed in a combination string. These formation evaluation tools may also include petrophysical and geosteering capabilities with higher resolution imaging and forward-looking sensors.

Oil drilling systems may also include measurement-while-drilling (MWD) systems, which may for example contain a survey tool that measures formation properties (e.g. resistivity, natural gamma ray, porosity), wellbore geometry (inclination, azimuth), drilling system orientation (tool face), and mechanical properties of the drilling process for drilling a well. MWD instruments or systems measure wellbore trajectory, provide magnetic or gravity tool faces for directional control and a telemetry system that pulses data up through the drill pipe as pressure waves. Examples of MWD measuring systems may use mud pulse or electromagnetic telemetry. MWD technology surveys can be used both as orientation surveys with steerable bottom whole assembly (BHA), or to replace magnetic multi-shot surveys while rotary drilling. Both LWD and MWD systems share this mode of communication to the surface and are combined as one string in a drilling assembly, i.e. a drill string.

FIG. 1 is a schematic diagram showing an oil drilling system at a wellsite according to an embodiment in this disclosure. The drilling system 100 in FIG. 1 has a derrick 1 above the surface, which is shown as land. However, the drilling system 100 may be over any other surface such as water. A kelly 2 drives a drill string 3 into a borehole 5. The lower part of the drill string 3 is a bottom hole assembly (BHA) 4, which includes a non-magnetic drill collar 8 with a MWD system (MWD assembly) 9 installed therein, LWD instruments 10, a downhole motor 11, the near-bit measurement sub 7, the drill bit 6, etc. During the drilling operation, the drilling system 100 may operate in the rotary mode, in which the drill string 3 is rotated from the surface either by the rotary table or a motor in the traveling block (i.e., a top drive). The drilling system 100 may also operate in a sliding mode, in which the drill string 3 is not rotated from the surface but is driven by the downhole motor 11 rotating the bit downhole. Drilling mud is pumped from the surface through the drill string 3 to the drill bit 6, being injected into the annulus between the drill string 3 and the wall of the well. The drilling mud carries the cuttings up from the well to the surface.

In one or more embodiments, the MWD system (MWD assembly) 9 may include a pulser sub, a pulser driver sub, a battery sub, a central storage unit, a master board, a power supply sub, a directional module sub, and other sensor boards. In some embodiments, some of these devices may be located in other areas of the BHA 4.

The non-magnetic drill collar 8 has the MWD system 9, which includes a package of instruments for measuring inclination, azimuth, well trajectory, etc. Also included in the non-magnetic drill collar 8 or other locations in the drill string 3 are LWD instruments 10 such as a neutron-porosity measurement tool and a density measurement tool, which are used to determined formation properties such as porosity and density. The instruments may be electrically or wirelessly coupled together, powered by a battery pack or a power generator driven by the drilling mud. All information gathered may be transmitted to the surface via a mud pulse telemetry system, electromagnetic transmission, or other communication system.

The measurement sub 7 may be disposed between the downhole motor 11 and drill bit 6, measuring formation resistivity, gamma ray, and the well trajectory. The data may be transmitted through the cable embedded in the downhole motor 11 to MWD or other communication devices. The downhole motor 11 may be connected to a bent housing that is adjustable at the surface from 1° to 3°, preferably up to 4°. Due to the slight bend in the bent housing, the drill bit 6 can drill a curved trajectory.

Figure 2:
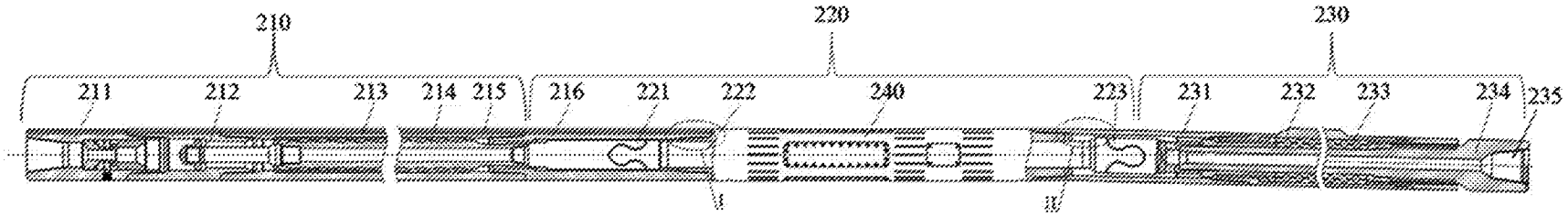
FIG. 2 is a schematic diagram showing a portion of a drilling tool according to an embodiment.

FIG. 2 is a schematic diagram showing a portion of a drilling tool according to an embodiment. FIG. 2 shows an example of a portion of a BHA 4 of a drill string 3 according to an embodiment. The BHA includes a downhole motor 210 (which is an example of downhole motor 11 in FIG. 1), a universal joint (i.e., u-joint) assembly 220, a measurement sub 240 (which is example of measurement sub 7 in FIG. 1) that fits over the u-joint connecting rod 222, and a drive shaft assembly 230. The universal joint assembly 220 contains an upper u-joint 221 proximal to the downhole motor 210, a lower u-joint 223 distal from the downhole motor 210, and the u-joint connecting rod 222 connecting the upper and lower u-joints. The drive shaft assembly 230 has a tubular drive shaft 234 having a proximal end coupled to the bent housing 231 and a distal end which is a box end 235 adapted to hold the drill bit (not shown in FIG. 2). A thrust bearing 233 is disposed between the drive shaft 234 and the bearing housing 232.

The drilling mud is pumped through the downhole motor 210, generating rotational movement of the rotor 214, which is translated through the u-joint assembly 220 to the drive shaft assembly 230. The drill bit (not shown in FIG. 2) installed in the box end 235 in the shaft assembly 230 is driven to rotate accordingly. The shaft assembly 230 also bears the axial and radial thrusts generated by drilling. The measurement sub 240 fits over the u-joint connecting rod 222 like a sleeve. The measurement sub 240 rotates together with the drilling assembly and, at the same time, measures formation information and wellbore trajectory, etc.

The downhole motor 210 can be a positive displacement motor (PDM), a Moineau motor, a turbine, or other suitable motors known in the art. As shown in FIG. 2, the downhole motor 210 has a dump valve assembly 211 and an anti-drop assembly 212. The dump valve assembly 211 has an open position or a closed position. When the downhole motor 210 is being tripped up, a bypass valve is open so that the mud can be drained into the annulus in the borehole. Furthermore, when the drilling mud flow rate and pressure reach certain pre-determined values, the bypass valve closes so that the drilling mud flows through the downhole motor 210. The anti-drop assembly 212 is also called safety-catch assembly, which can be used to remove the downhole motor 210 from the well when there is a motor connection failure. The anti-drop assembly 212 may cause the mud pressure to quickly rise, alerting the surface about the connection failure when it occurs.

As shown in FIG. 2, the measurement sub 240 is disposed about the u-joint connecting rod 222 between the upper u-joint 221 and the lower u-joint 223. In this embodiment, the measurement sub 240 is tubular in shape with a hollow center in its longitudinal direction. The u-joint connecting rod 222 extends through the hollow center of the measurement sub 240. The upper u-joint 221 (on the proximal end of the u-joint connecting rod 222) is coupled to the distal end of the rotor 214 while the lower u-joint 223 (on the distal end of the u-joint connecting rod 222) is coupled to the proximal end of the drive shaft 234. The stator adaptor 216 serves as a transition piece to couple together the measurement sub 240 and the downhole motor 210. The upper proximal end of the stator adaptor 216 is coupled to the stator 213 of the downhole motor 210 while its distal end is connected to the upper threadable connection of the measurement sub 240. The lower threadable connection of the measurement sub 240 is connected to the bent housing 231. The length of the measurement sub 240 may vary according to instruments it accommodates. The length of the u-joint connecting rod 222 and the length of the stator adaptor 216 vary according to the length of the measurement sub 240, and vice versa.

Data gathered by the measurement sub 240 are sent to the MWD system (MWD assembly) 9, which may be located above the downhole motor 210 and transmitted to the surface from there. The measurement sub integrates modules for detecting gamma ray, resistivity, and formation density. The measurements are directional or azimuthal so that data better reflects properties of formation near the borehole sections by sections. Since the azimuthal measurement of the borehole is usually obtained using fluxgate magnetometers, the measurement is subject to interference from the electromagnetic field surrounding the tool.

As discussed above, the measurement sub 240 may contain sensors and circuitries for measuring resistivity, gamma ray, and wellbore trajectory such as wellbore inclination. In addition, the measurement sub 240 can be powered by a battery pack installed in the measurement sub 240 itself or at a location above the downhole motor 210, or by power generated in a turbine generator driven by the drilling mud. Accordingly, there are channels for data communications and/or power transmission between the measurement sub 240 and instruments above the downhole motor 210.

In an embodiment shown in FIG. 2, the power for the measurement sub 240 may be supplied by instruments above the downhole motor 210. The stator 213 in the downhole motor has one or more conduits 215 for housing electrical wires/data cables, connecting the measurement sub 240 and instruments (e.g., MWD tools, not shown in FIG. 2) above the downhole motor 210. The conduit 215 can be a channel machined into the surface of the stator 213 or built in the elastomer layer inside the stator 213. The data cable allows stable and fast data transmissions.

In an embodiment, the measurement sub 240 may also have a wireless communication module, which communicates with a corresponding module installed above the downhole motor 210, establishing data communications between the two modules by electromagnetic signals.

As discussed above, the measurement sub 240 is an example of measurement sub 7 in a bottom hole assembly 4 of drill string 3 in FIG. 1. One or more sensors may be installed in the measurement sub 7 as well as other locations in the bottom whole assembly 4 to measure and collect sensor data. In one or more embodiments, sensor data will be transmitted or be made available to an MWD assembly such as MWD assembly 9.

Figure 3:
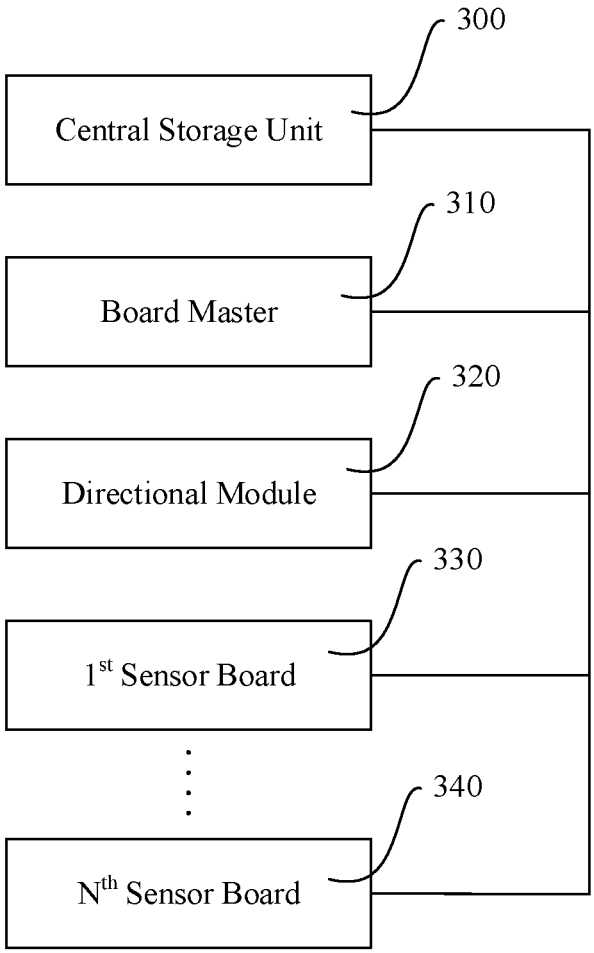
FIG. 3 is a schematic diagram showing some components of an MWD assembly according to an embodiment.

FIG. 3 is a schematic diagram showing some components of an MWD system (MWD assembly) 9 in the bottom whole assembly (BHA) 4 according to an embodiment. FIG. 3 shows a central storage unit (CSU) 300 coupled to a master board 310, a directional module 320, and one or more sensor boards (e.g. a plurality of sensor boards from a first sensor board to an $N^{TH}$ sensor board where N is a natural number (counting number)). For example, central storage unit 300 is coupled to a first sensor board 330 and an $N^{TH}$ sensor board 340. Sensor boards may include a sensor board micro controller unit (MCU) or a central processing unit (CPU). Individual sensors on the sensor boards or communicating with the sensor boards may also have a microcontroller unit or a central processing unit.

The master board 310 is the core of the MWD system 9. The master board 310 has a master board micro controller unit (MCU) and various internal and external buses to communicate with other sensors. The master board MCU may be firmware. The master board MCU may control the one or more sensor boards including one or more sensors to sense data.

The directional module 320 may have components for providing information regarding the conditions and direction of the drill string 3. For example, the directional module 320 may have one or more directional sensors, one or more accelerometers, one or more magnetometers, and one or more temperature sensors. The directional module 320 may be equipped with an MCU or may rely on the MCU of the master board 310.

The central storage unit 300 may be a universal storage board instead of an external flash memory on a master board 310. The central storage unit (CSU) 300 has many advantages. For example, in a traditional MWD system, external storage for storing sensor data is mounted on the master board frequently by soldering. This may cause damage to the master board during manufacturing or during actual use of the master circuit board in the traditional MWD system. The central storage unit (CSU) 300 is a separate board, which is not mounted to the master board, which reduces the possibility of damage to the master board as well as damage to the storage of sensor data on the central storage unit (CSU) 300. Moreover, because the central storage unit (CSU) 300 is a board, it is relatively easy to connect to the MWD system by touching and firmly inserting (or otherwise connecting) the central storage unit (CSU) 300 to the MWD system without damaging the central storage unit (CSU) 300 board or the MWD system. In addition, the central storage unit 300 has a central storage unit (CSU) micro controller unit, which is not controlled by a master board micro controller unit (MCU) on master board 310. The CSU micro controller unit may not be controlled by any other controller or any other board. The CSU micro controller unit may be firmware. Further, the central storage unit 300 has a large storage capacity, which may include one or more memory storage devices such as a secure digital (SD) card, miniSD card, microSD card, and/or other memory storage devices (storage devices). Moreover, the central storage unit 300 may have a much larger storage capacity by using a SD card array, a miniSD card array, a microSD card array, and/or one or more arrays of storage devices.

In addition, the central storage unit 300 is removable from the MWD system 9. Therefore, the entire MWD assembly 9 does not have to be removed from the bottom whole assembly (BHA) 4 of the drill string 3. Moreover, each of the one or more memory storage devices (storage devices) is removable (e.g., plug-in/plug-out). Further, the central storage unit 300 may record sensor data by attaching the central storage unit 300 to one or more internal buses. The central storage unit 300 may store (record) sensor data received or made available by other sensor boards such as the first sensor board 330. The removability of the central storage unit 300 and the memory storage devices on the central storage unit 300 avoids removing or working with the entire MWD system 9 to transfer sensor data from the one or more memory storage devices of the central storage unit 300 to another memory or computing device for further processing or retrieval. In addition, the removability of the central storage unit 300 and the memory storage devices on the central storage unit 300 avoids the use of the master board 310 to transfer sensor data from the MWD system 9 to another memory or computing device. For example, if the master board 310 is damaged or fails in any way, this damage or failure of the master board 310 has no impact on the transfer of sensor data from the central storage unit (CSU) 300 to another memory or computing device. The master board 310 does not participate in the transfer of sensor data from the central storage unit (CSU) 300 to another memory or computer device (e.g., a personal computer) for further processing or retrieval.

As discussed above, the central storage unit 300 is coupled to a plurality of sensor boards from a first sensor board to an $N^{TH}$ where N is a natural number (counting number). For example, in FIG. 3, central storage unit 300 is coupled to a first sensor board 330 and an $N^{TH}$ sensor board 340. Each sensor board may include one or more sensors to collect sensor data through sensors. These sensors may take measurements and/or detect whatever the sensor is designed to detect. In some embodiments, one or more sensors may output the sensor data on an internal common bus periodically. This central storage unit 300 may be connected to the internal bus. Alternatively, in some embodiments, the master board MCU may send an acquisition command to one or more sensor boards to measure, detect, and/or collect sensor data by way of an internal bus. The acquisition command may include one or more identifiers to identify one or more sensors. An example of an internal bus is a control area network (CAN) bus. The master board MCU acquisition command may also instruct the one or more sensors to output the sensor data on the internal bus. The central storage unit 300 may be coupled to the one or more sensor boards by the same internal bus. Regardless of how the sensor data is output to the internal bus, the central storage unit 300 may retrieve or receive the sensor data from the internal bus. Examples of the internal bus may include a CAN bus, a Q-bus or a serial bus (e.g. recommended standard (RS) 232 Serial Bus). The central storage unit 300 may be a data recorder which records sensor data. In addition, the central storage unit 300 may save other types of data such as communication data.

Figure 4:
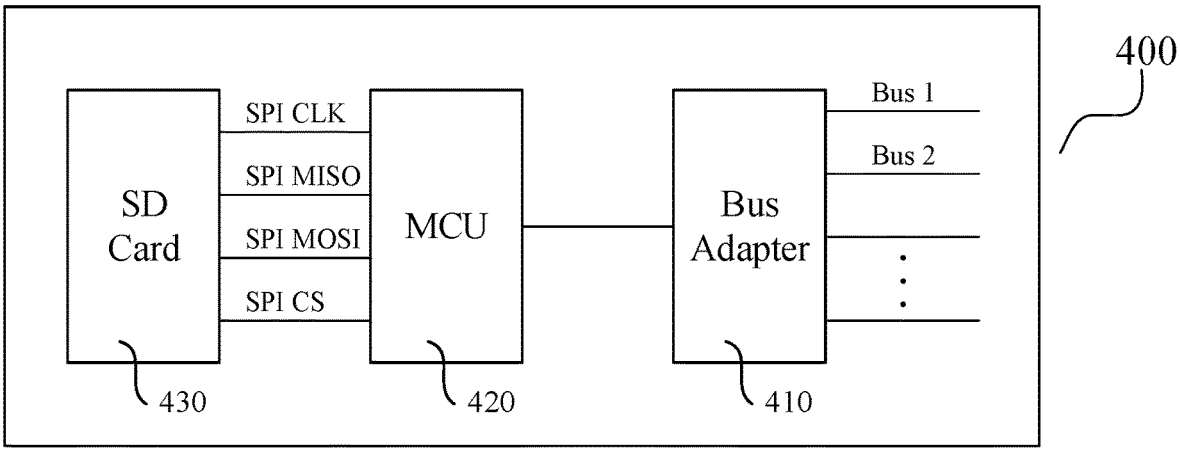
FIG. 4 is a schematic diagram showing a central storage unit according to an embodiment.

FIG. 4 is a schematic diagram showing an example of a central storage unit 400 according to an embodiment. Central storage unit 400 in FIG. 4 is an example of the central storage unit 300 in FIG. 3. The central storage unit 400 includes a bus adapter 410, a micro controller unit (MCU) 420, and one secure digital (SD) card 430. One SD card may store 500 GB or more of sensor data. The bus adapter 410 may couple the central storage unit 400 to one or more of buses, which are coupled to one or more sensors on one or more sensor boards. The one or more buses may also be referred to as an internal bus or may be referred to as one or more internal buses. The bus adapter 410 may be implemented by a firmware driver in the MCU 420 and bus controller chips as needed. The bus adapter 410 receives sensor data from one or more buses or retrieves sensor data using the one or more buses from the one or more sensors on one or more sensor boards. The MCU 420 receives the sensor data from bus adapter 410 or retrieves sensor data from the bus adapter 410.

The MCU 420 may be coupled to an SD card 430 by a plurality of lines (e.g. wires), which may form a bus. The lines may also be referred to as connectors. In some embodiments such as the embodiment shown in FIG. 4, the MCU 420 may be coupled to an SD card 430 by a serial peripheral interface (SPI) bus, which may be a 4-line bus (first through fourth connectors or first through fourth wires). One line referred to as SPI CLK (first line) may supply a serial clock signal from the MCU 420 to the SD card 430. The SPI CLK (first line) may also be referred to as SCK to denote a serial clock. The SPI bus may also include two data lines (second line and third line). The two data lines output or make available sensor data, which may be stored (recorded) in the SD card 430. The second line may be referred to as SPI MISO (serial peripheral interface master-in/slave-out). The third line may be referred to as SPI MOSI (serial peripheral interface master-out/slave-in). Another line referred to as an SPI CS (serial peripheral interface chip select) line may supply an enable signal or a disable signal from the MCU 420 to the SD card 430. The SPI CS line may also be referred to as a select line (fourth line). The SPI CS line may also be referred to as an SPI SS to denote a slave select line. In the communication relationship between the MCU 420 and the SD Card, the MCU 420 is referred to as the master and SD Card 430 is referred to as the slave.

The MCU 420 may output a serial clock signal on the SPI CLK line to SD card 430. The MCU 420 may make available or output sensor data, which may be stored in the SD card 430. An enable signal or a disable signal (select signal or deselect signal) may be outputted or made available on the SPI CS line. The sensor data, obtained by the MCU 420 from bus adapter 410, may be outputted to or read from the SPI MISO line and SPI MOSI line of the MCU 420. If the enable signal is outputted or made available on the SPI CS line, the sensor data may be received by way of the SPI MISO line and the SPI MOSI line or read by using the SPI MISO line and the SPI MOSI line. Thereafter, the sensor data may be stored (recorded) in the SD card 430. Accordingly, in the embodiment shown in FIG. 4, the removable SD card 430 may store (record) sensor data collected by the one or more sensors on the one or more sensor boards. The removable SD card 430 may be removed and the sensor data may be transferred and/or retrieved for further storage or processing of the sensor data by another computing device.

Figure 5:
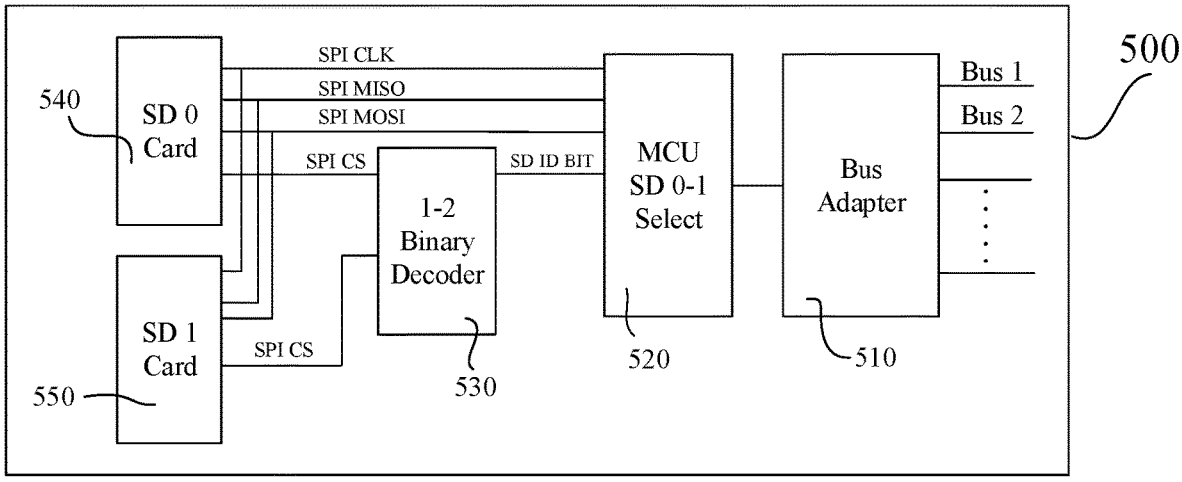
FIG. 5 shows a schematic diagram of a central storage unit according to an embodiment.

FIG. 5 shows a schematic diagram of a central storage unit 500 according to an embodiment. Central storage unit 500 in FIG. 5 is an example of the central storage unit 300 in FIG. 3. The central storage unit 500 includes a bus adapter 510, a micro controller unit (MCU) 520, a binary decoder 530, a first secure digital (SD) card 540, and a second SD card 550. One SD card may store 500 GB or more of sensor data. The first SD card 540 and the second SD card 550 may be removable. The central storage unit 500 may also be removable.

The bus adapter 510 may couple the central storage unit 500 to one or more buses, which are coupled to one or more sensors on one or more sensor boards. The one or more buses may also be referred to as an internal bus or may be referred to as one or more internal buses. The bus adapter 510 may be implemented by a firmware driver in the MCU 520 and bus controller chips as needed. The bus adapter 510 receives sensor data from one or more buses or retrieves sensor data using the one or more buses from the one or more sensors on one or more sensor boards. The MCU 520 receives the sensor data from bus adapter 510 or retrieves sensor data from the bus adapter 510.

In the exemplary embodiment shown in FIG. 5, the MCU 520 may be coupled to the first SD card 540 and the second SD card 550 by a plurality of lines (e.g. wires), which may form a bus. The plurality of lines may also be referred to as connectors. In some embodiments such as the embodiment shown in FIG. 5, the MCU 520 may be coupled to a SD card 540 and a SD card 550 by lines of a four line serial peripheral interface (SPI) bus, which may be a 4-line bus (first through fourth connectors or first through fourth wires). More specifically, one line referred to as SPI CLK (first line) may supply a serial clock signal from the MCU 520 to the SD cards 540 and 550. The SPI CLK (first line) may also be referred to as SCK to denote a serial clock. The SPI bus may also include two data lines (second line and third line). The two data lines output or make available sensor data. The second line may be referred to as SPI MISO (serial peripheral interface master-in/slave-out). The third line may be referred to as SPI MOSI (serial peripheral interface master-out/slave-in). In the communication relationship between the MCU 520 and the SD Card 540 and the SD Card 550, the MCU 520 is referred to as the master and the SD Card 540 and the SD Card 550 are each referred to as the slave.

In the exemplary embodiment shown in FIG. 5, a fourth line of the SPI bus may be coupled to the MCU 520 to a binary decoder 530. The fourth line may be referred to as an identification bit line. The binary decoder 530 may be a 1-2 binary decoder, which receives a signal on the identification bit line denoted as SD ID BIT. The binary decoder 530 may be coupled to the first SD card 540 (SD 0) through a first SPI CS line and the second SD card 550 (SD 1) through a second SPI CS line. The "CS" may denote chip select and may also be referred to as "SS" to denote slave select. The signal on the identification bit line may represent a high signal or a low signal. The high or low signal outputted or made available by the identification bit line is a command or instruction from the MCU 520 to the binary decoder 530, which the binary decoder 530 uses to select (enable or disable) the first SD card 540 or the second SD card 550. Accordingly, the MCU is also coupled to the first SD card 540 and the second SD card 550 through a binary decoder 530.

By using the fourth line (identification bit line), the MCU 520 may command or instruct the binary decoder 530 to place an enable signal on the first SPI CS line and a disable signal on the second SPI CS line, so that sensor data may be received or retrieved from the two data lines SPI MISO and SPI MOSI by the first SD card 540. The first SD card 540 may then store the sensor data in the first SD card 540. By using the fourth line, the MCU 520 may also command or instruct the binary decoder 530 to place a disable signal on the first SPI CS line and an enable signal on the second SPI CS line, so that sensor data may be received or retrieved from the two data lines SPI MISO and SPI MOSI by the second SD card 550. The second SD card 550 may then store the sensor data in the second SD card 550.

In some embodiments, the MCU 520 may store one or more types of sensor data on a first SD card 540 and store one or more other types of sensor data on the second SD card 550 through instructions to the binary decoder 530 on the fourth line. The type of sensor data may be identified based on an identifier obtained and analyzed by the MCU 520.

In some embodiments, the MCU 520 may select the second SD card 550 to store sensor data when the first SD card 540 has already stored a maximum amount of sensor data or the first SD card 540 is unavailable (e.g., damaged or removed). In some embodiments, the MCU 520 may select the first SD card 540 to store sensor data when the second SD card 550 has already stored a maximum amount of sensor data or the second SD card 550 is unavailable (e.g., damaged or removed). In some embodiments, the MCU 520 may select the first SD card 540 to store sensor data until the maximum amount of sensor data which can be stored on first SD card 540 is stored. Once the first SD card 540 has stored as much sensor data as possible, the MCU 520 may select the second SD card 550 to store the additional sensor data.

In some embodiments, the MCU 520 may output a serial clock signal on the SPI CLK line to both the first SD card 540 and the second SD card 550. The MCU 520 may also make available or output sensor data for storage by at least one of the first SD card 540 and the second SD card 550. However, the first SD card 540 and/or the second SD card 550 must be selected to store the sensor data. As discussed above, the binary decoder 530 may be coupled to the first SD card 540 (SD 0) through a first SPI CS line and the second SD card 540 (SD 1) through a second SPI CS line. The first SD card 540 is selected by an enable signal on the first SPI CS line. The second SD card 550 is selected by an enable signal on the second SPI CS line. Once one or more SD cards are selected, the one or more SD cards may receive or retrieve the clock signal on the SPI CLK line and the sensor data from the two data lines SPI MISO and SPI MOSI for storage in the one or more SD cards. Thereafter, the sensor data may be stored (recorded) in one or more of the first SD card 540 and the second SD card 550. Accordingly, in the embodiment shown in FIG. 5, the one or more removable SD cards 540 and 550 store (record) sensor data collected by one or more sensors on the one or more sensor boards. The one or more removable SD cards 540 and 550 may be removed and the sensor data stored on the one or more removable SD cards 540 and 550 may be transferred and/or retrieved for further storage or processing of the sensor data by another computing device.

Figure 6:
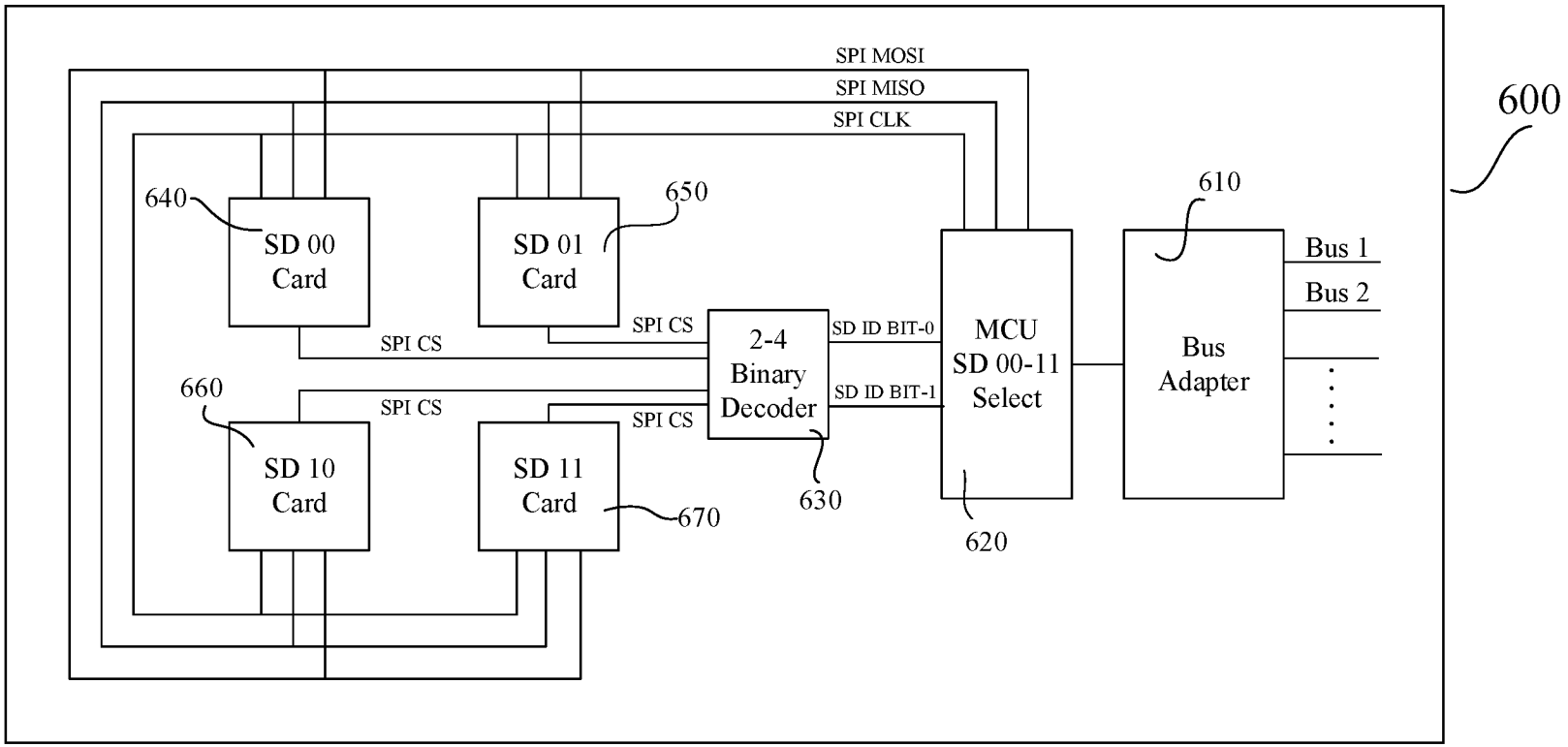
FIG. 6 is a schematic diagram showing a central storage unit according to an embodiment.

FIG. 6 is a schematic diagram showing a central storage unit 600 according to an embodiment. Central storage unit 600 in FIG. 6 is an example of the central storage unit 300 in FIG. 3. The central storage unit 600 includes a bus adapter 610, a micro controller unit (MCU) 620, a binary decoder 630, a first secure digital (SD) card 640 (SD 00 Card), a second SD card 650 (SD 01 Card), a third SD card 660 (SD 10 Card), and a fourth SD card 670 (SC 11 Card). One SD card may store 500 GB or more of sensor data. The first SD card 640, the second SD card 650, the third SD card 660, and the fourth SD card 670 may be removable. The central storage unit 600 may be removable.

The bus adapter 610 may couple the central storage unit 600 to one or more buses, which are coupled to one or more sensors on one or more sensor boards. The one or more buses may also be referred to as an internal bus or may be referred to as one or more internal buses. The bus adapter 610 may be implemented by a firmware driver in the MCU 620 and bus controller chips as needed. The bus adapter 610 receives sensor data from one or more buses or retrieves sensor data using the one or more buses from the one or more sensors on one or more sensor boards. The MCU 620 receives the sensor data from bus adapter 610 or retrieves sensor data from the bus adapter 610.

In the exemplary embodiment shown in FIG. 6, the MCU 620 may be coupled to the first SD card 640, the second SD card 650, the third SD card 660, and the fourth SD card 670 by a plurality of lines (e.g. wires), which may form a bus. The plurality of lines may also be referred to as connectors. In some embodiments such as the embodiment shown in FIG. 6, the MCU 620 may be coupled to the first SD card 640, the second SD card 650, the third SD card 660, and the fourth SD card 670 by a lines of a serial peripheral interface (SPI) bus. More specifically, one line referred to as SPI CLK (first line) may supply a serial clock signal from the MCU 620 to the SD cards 640-670. The SPI CLK (first line) may also be referred to as SCK to denote a serial clock. The SPI bus may also include two data lines (second line and third line). The two data lines output or make available sensor data. The second line may be referred to as SPI MISO (serial peripheral interface master-in/slave-out). The third line may be referred to as SPI MOSI (serial peripheral interface master-out/slave-in). In the communication relationship between the MCU 620 and the SD cards 640-670, the MCU 620 is referred to as the master device and the SD cards 640-670 are each referred to as the slave devices.

In the exemplary embodiment shown in FIG. 6, a fourth line and a fifth line may couple the MCU 620 to a binary decoder 630. The fourth line may be referred to as an identification bit line zero (SD ID BIT-0 or first identification bit line) and the fifth line may be referred to as an identification bit line 1 (SD ID BIT-1 or second identification bit line). The binary decoder 630 may be a 2-4 binary decoder, which receives a signal on the first identification bit line and another signal on the second identification bit line. The binary decoder 630 may be coupled to the first SD card 640 (SD 00) through a first SPI CS line, the second SD card 650 (SD 01) through a second SPI CS line, the third SD card 660 (SD 10) through a third SPI CS line, and the fourth SD card 670 (SD 11) through a fourth SPI CS line. The "CS" may denote chip select and may also be referred to as "SS" to denote slave select.

By using the fourth line (first identification bit line) and the fifth line (second identification bit line), the MCU 620 may command or instruct the binary decoder 630 to place an enable signal on the first SPI CS line and a disable signal on the second SPI CS line, the third SPI CS line, and the fourth SPI CS line, so that sensor data may be received or retrieved from the two data lines SPI MISO and SPI MOSI by the first SD card 640. The first SD card 640 may then store the sensor data in the first SD card 640. By using the fourth line and the fifth line, the MCU 620 may also command or instruct the binary decoder 630 to place an enable signal or disable signal on any of the first through fourth SPI CS lines to enable any SD card to obtain and store (record) sensor data using the two data lines SPI MISO and SPI MOSI in accordance with the clock signal on the SPI CLK line.

In some embodiments, the MCU 620 may store one or more types of sensor data on one or more selected SD cards from among the SD cards 640-670 through commands and/or instructions to the binary decoder 630 on the fourth line and the fifth line. The type of sensor data may be identified based on an identifier obtained and analyzed by the MCU 620. Based on the commands and/or instructions obtained by the binary decoder 630, the binary decoder 630 selects one or more of the first through fourth SD cards 640-670.

More specifically, in some embodiments, the MCU 620 may output a serial clock signal on the SPI CLK line to the first through fourth SD cards 640-670. The MCU 620 may also make available or output sensor data for storage by at least one of first through fourth SD cards 640-670. However, each of the first through fourth SD cards 640 through 670 must be selected to store the sensor data. As discussed above, the binary decoder 630 receives commands and/or instructions from MCU 620 regarding selecting an SD card to store (record) sensor data/ The binary decoder 630 may be coupled to the first SD card 640 (SD 00) through a first SPI CS line, the second SD card 650 (SD 01) through a second SPI CS line, the third SD card 660 (SD 10) through a third SPI CS line, and the fourth SD card 670 (SD 11) through a fourth SPI CS line. The first SD card 640 is selected by an enable signal on the first SPI CS line. The second SD card 650 is selected by an enable signal on the second SPI CS line. The third SD card 660 is selected by an enable signal on the third SPI CS line. The fourth SD card 670 is selected by an enable signal on the fourth SPI CS line.

Once one or more SD cards are selected, the one or more SD cards may receive or retrieve the clock signal on the SPI CLK line and the sensor data from the two data lines SPI MISO and SPI MOSI for storage in the one or more SD cards. Thereafter, the sensor data may be stored (recorded) in one or more of the first SD card 640, the second SD card 650, the third SD card 660, and the fourth SD card 670. Accordingly, in the embodiment shown in FIG. 6, the one or more removable SD cards 640 and 650 store (record) sensor data collected by one or more sensors on the one or more sensor boards. The one or more removable SD cards 640-670 may be removed and the sensor data stored on the one or more removable SD cards 640-670 may be transferred and/or retrieved for further storage or processing of the sensor data by another computing device.

Figure 7:
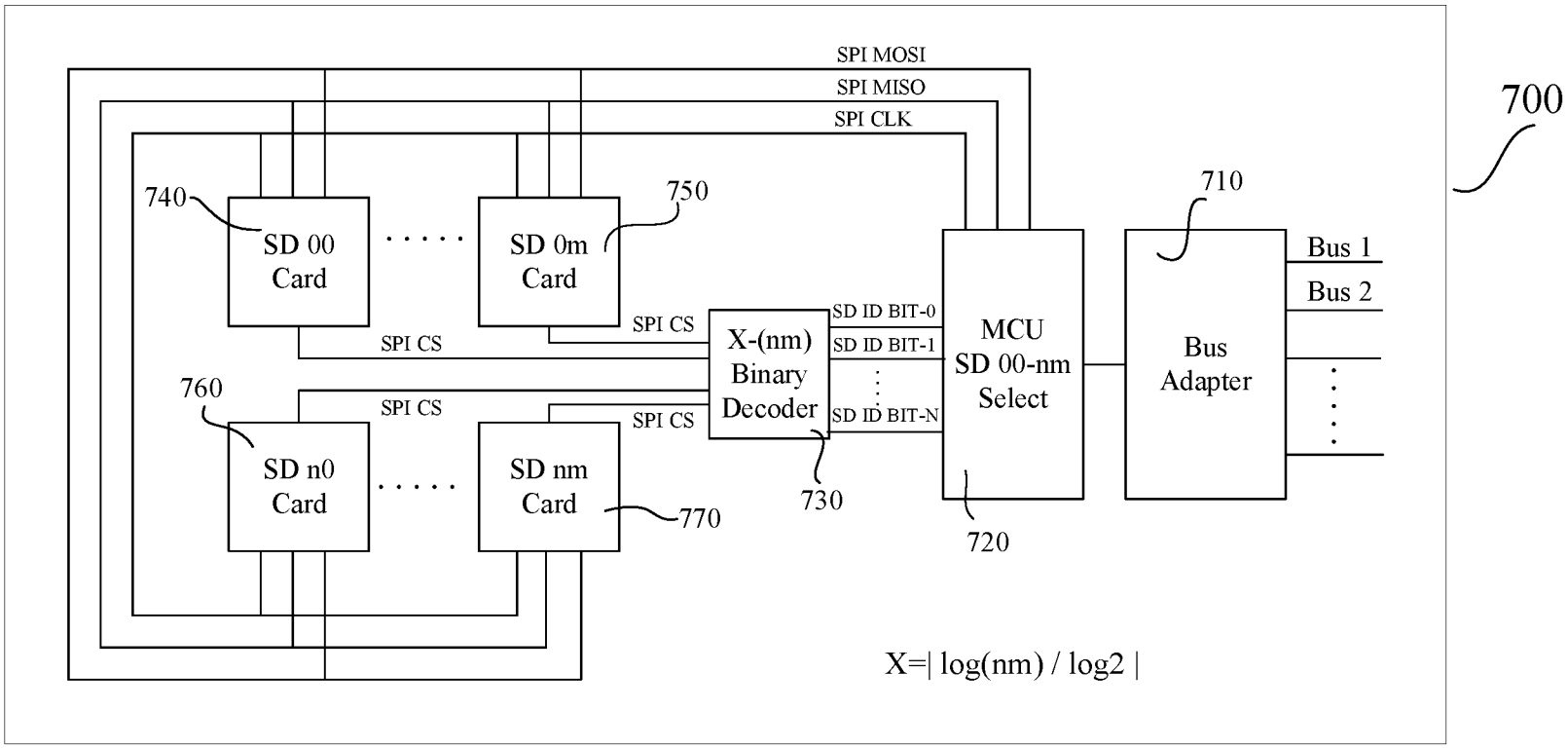
FIG. 7 is a schematic diagram showing a central storage unit according to an embodiment.

FIG. 7 is a schematic diagram showing a central storage unit 700 according to an embodiment. Central storage unit 700 in FIG. 7 is an example of the central storage unit 300 in FIG. 3. The central storage unit 700 includes a bus adapter 710, a micro controller unit (MCU) 720, a binary decoder 730, a secure digital (SD) 00 card 740, a SD 0m card 750, a SD n0 card 760, and a SD nm card 770. The reference letter "n" may be a natural number (counting number) and the letter "m" may be a natural number (counting number). In this embodiment, there may be a n by m array of SD cards. The total number of SD cards in the array is the product of n and m. One SD card may store 500 GB or more of sensor data.

The bus adapter 710 may couple the central storage unit 700 to one or more buses, which are coupled to one or more sensors on one or more sensor boards. The one or more buses may also be referred to as an internal bus or may be referred to as one or more internal buses. The bus adapter 710 may be implemented by a firmware driver in the MCU 720 and bus controller chips as needed. The bus adapter 710 receives sensor data from one or more buses or retrieves sensor data using the one or more buses from the one or more sensors on one or more sensor boards. The MCU 720 receives the sensor data from bus adapter 710 or retrieves sensor data from the bus adapter 710.

In the exemplary embodiment shown in FIG. 7, the MCU 720 may be coupled to each SD card in the n by m array of SD cards, which may include the SD 00 card 740, the SD 0m card 750, the SD n0 card 760, and the SD nm card 770. The MCU 720 may be coupled to each SD card in the n by m array of SD cards by a plurality of lines, which may form a bus. The plurality of lines may also be referred to as connectors. In some embodiments, such as the exemplary embodiment shown in FIG. 7, the MCI 720 may be coupled to the SD cars by lines of a serial bus. More specifically, one line referred to as SPI CLK (first line) may supply a serial clock signal from the MCU 720 to the SD cards from the SD 00 card denoted by reference numeral 740 through the SD nm card denoted by reference numeral 770. The SPI CLK (first line) may also be referred to as SCK to denote a serial clock. The SPI bus may also include two data lines (second line and third line). The two data lines output or make available sensor data. The second line may be referred to as SPI MISO (serial peripheral interface master-in/slave-out). The third line may be referred to as SPI MOSI (serial peripheral interface master-out/slave-in). In the communication relationship between the MCU 720 and the array of SD cards, the MCU 720 is referred to as the master device and the each of SD cards in the n×m array of SD cards is referred to as a slave device.

In the exemplary embodiment shown in FIG. 7, additional lines may couple the MCU 720 to the nm binary decoder 730. The additional lines may be generally referred to as identification bit lines because the identification bit lines may carry signals to the nm binary decoder 730. These signals may be commands and/or instructions to command the nm binary decoder 730 to select or deselect one or more SD cards in the array of SD cards. When a SD card is selected, then the SD card can receive or retrieve data from the two data lines SPI MISO and SPI MOSI in accordance with a clock signal carried on SPI CLK. As shown in FIG. 7, the first identification bit line may be denoted as SD ID BIT-0 and the second identification bit line may be denoted as SD ID BIT-1. Each bit line may be identified by a natural number (counting number) up to the last bit line denoted as SD ID BIT-n. The signals on the identification bit lines are received or retrieved from the identification bit lines to instruct or command the nm binary decoder 730 to select or deselect each SD card in the n×m SD card array sending a signal on a separate line to teach of the SD cards in the n×m SD card array. Alternatively, the nm binary decoder 730 could select or deselect each SD card in the n×m SD card array by allowing each SD card to retrieve a select or deselect signal from the nm binary decoder 730. Each line coupling the nm binary decoder to a SD card in the n by m SD card array is denoted by SPI CS (serial peripheral interface chip select), so that the nm binary decoder 730 may select and deselect each SD card in the n by m array of SD cards. As discussed above, this selection is based upon one or more commands or instructions from MCU 720 through the use of identification bit lines.

In some embodiments, the MCU 720 may store one or more types of sensor data on one or more selected SD cards from among the SD cards in the n by m SD card array by sending commands and/or instructions or making available commands and/or instructions to the binary decoder 730. The type of sensor data may be identified based on an identifier obtained and analyzed by the MCU 720. Based on the commands and/or instructions obtained by the binary decoder 730, the binary decoder 730 selects one or more of the SD cards in the n by m array of SD cards.

In some embodiments, once one or more SD cards are selected, the one or more SD cards may receive or retrieve the clock signal on the SPI CLK line and the sensor data from the two data lines SPI MISO and SPI MOSI for storage in the one or more SD cards. Thereafter, the sensor data may be stored (recorded) in one or more of the n by m SD cards in the SD card array. Accordingly, in the embodiment shown in FIG. 7, the one or more removable SD cards store (record) sensor data collected by one or more sensors on the one or more sensor boards. The one or more removable SD cards may be removed, and the sensor data stored on the one or more removable SD cards may be transferred and/or retrieved for further storage or processing of the sensor data by another computing device.

Figure 8:
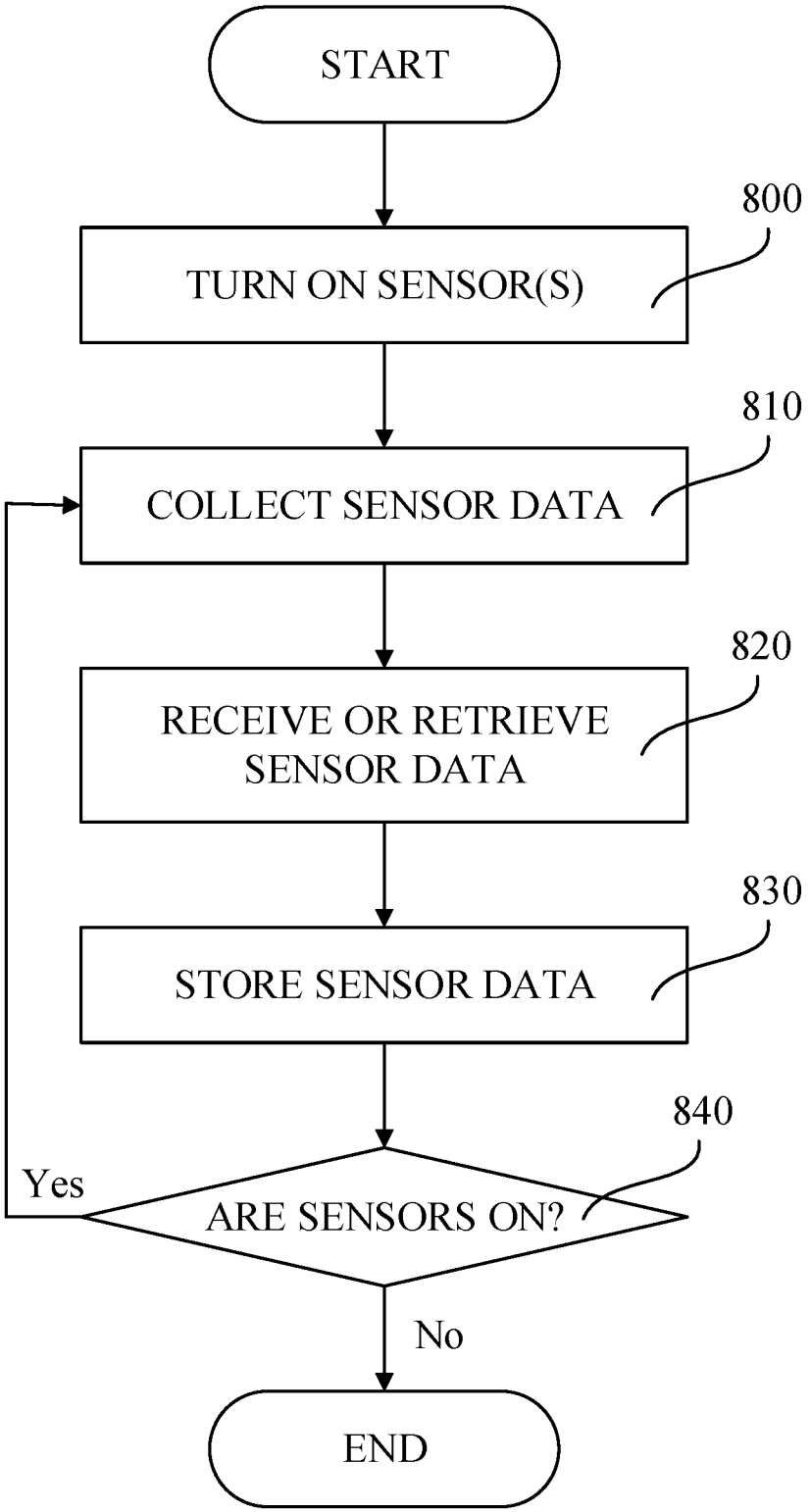
FIG. 8 is a flow chart showing a process of collecting sensor data from one or more sensors and storing the collected sensor data for retrieval and further processing according to an embodiment.

FIG. 8 is a flow chart showing a process of collecting sensor data from one or more sensors and storing the collected sensor data for retrieval and further processing according to an embodiment. As discussed above with respect to FIG. 3, the master board 310 is the core of the MWD system 9. The master board 310 has a master board micro controller unit (MCU) and various internal and external buses to communicate with sensors. The master board MCU may be firmware. The master board MCU may control the one or more sensor boards including one or more sensors to sense data. FIG. 3 shows a first sensor board 330 through an $N^{TH}$ sensor board 340, which may all be coupled to the master board 310 and controlled by the master board MCU. As discussed above, "N" may be a natural number (counting number). In operation 800, one or more sensors on one or more sensor boards may be turned on to sense data when one or more commands or instructions from the master board MCU are received by the one or more sensor boards. Once the sensor boards receive the commands or instructions, the sensors may be commanded or instructed to sense data. Alternatively, in operation 800, one or more sensors may be turned on by one or more commands or instructions being retrieved by the one or more sensor boards from one or more lines or a bus coupling the one or more sensor boards to the master board MCU. Once the sensor boards retrieve the commands or instructions, the sensors may be commanded or instructed to sense data.

In operation 810, the one or more sensors, which are sensing data, provide sensor data to one or more sensor boards for data collection. The one or more sensor boards collecting data may periodically output the collected data onto one or more lines or a bus, which couple the one or more sensor boards to the central storage unit 300. Alternatively, the one or more sensor boards collecting data may periodically make the collected data available for retrieval using one or more lines or a bus. The one or more lines or bus may couple the one or more sensor boards to the central storage unit 300.

Alternatively, in operation 810, the one or more sensors, which are sensing data, provide sensor data to one or more sensor boards for data collection. Upon a request from the master board 310 or the central storage unit 300, the one or more sensor boards collecting data may output the collected data onto one or more lines or buses coupled to the central storage unit 300. Alternatively, upon a request from the master board 310 or the central storage unit 300, the one or more sensor boards collecting data may make the collected data available for retrieval by the central storage unit 300 on one or more lines or a bus coupled to the central storage unit 300.

As discussed above, the central storage unit 300 may be a universal storage board instead of an external flash memory on a master board 310. The central storage unit (CSU) 300 has many advantages. For example, the central storage unit 300 has a central storage unit (CSU) micro controller unit, which is not controlled by a master board micro controller unit (MCU) on master board 310.

In operation 820, the central storage unit 300 collects or retrieves the sensor data from one or more lines or a bus. In operation 830, the central storage unit 300 stores the sensor data. Examples of the central storage unit 300 to store the sensor data are shown in FIGS. 4-7. In operation 840, the master board MCU of the master board 310 determines whether one or more sensors continue to sense data. If the one or more sensors no longer sense data, the operations end until the one or more sensors are turned on again in operation 800. If one or more sensors continue to sense data, the sensor data continues to be collected in operation 810.

Processes, functions, methods, and/or software in apparatuses described herein may be recorded, stored, or fixed in one or more non-transitory computer-readable media (computer readable storage (recording) media) that includes program instructions (computer readable instructions) to be implemented by a computer to cause one or more processors to execute (perform or implement) the program instructions. The media may also include, alone or in combination with the program instructions, data files, data structures, and the like. The media and program instructions may be those specially designed and constructed, or they may be of the kind well-known and available to those having skill in the computer software arts. Examples of non-transitory computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The program instructions may be executed by one or more processors. The described hardware devices may be configured to act as one or more software modules that are recorded, stored, or fixed in one or more non-transitory computer-readable media, in order to perform the operations and methods described above, or vice versa. In addition, a non-transitory computer-readable medium may be distributed among computer systems connected through a network and program instructions may be stored and executed in a decentralized manner. In addition, the computer-readable media may also be embodied in at least one application specific integrated circuit (ASIC) or Field Programmable Gate Array (FPGA). The non-transitory computer readable media may include firmware such as micro controller units. The ASIC may be an example of firmware.

While embodiments of this disclosure have been shown and described, modifications can be made by one skilled in the art without departing from the spirit or teaching of this invention. The embodiments described herein are exemplary only and are not limiting. Many variations and modifications of methods, systems and apparatuses are possible and are within the scope of the invention. Accordingly, the scope of protection is not limited to the embodiments described herein. The scope of protection is only limited by the claims. The scope of the claims shall include all equivalents of the subject matter of the claims.

What is claimed is:

1. An apparatus for collecting and storing sensor data for an oil drilling system, comprising:

a drill string including a bottom whole assembly which includes a drill bit and a measurement-while-drilling (MWD) assembly;

a master board including a master board micro controller unit (MCU) in the MWD assembly;

a plurality of sensor boards to sense and collect the sensor data;

a central storage unit, including a central storage unit MCU in the MWD assembly, to store the sensor data collected by the plurality of sensor boards; and an internal bus coupled to the master board, the plurality of sensor boards, and the central storage unit to carry the sensor data from the plurality of sensor boards to the central storage unit for storage by the central storage unit, wherein the central storage unit is removable from the MWD assembly, wherein the central storage unit comprises a secure digital (SD) card array comprising a plurality of SD cards, the central storage unit MCU, and a binary decoder, wherein the central storage unit MCU is connected to . . . and is connected to the binary decoder via an identification bit line configured to carry a command to enable or disable the plurality of SD cards, and wherein the binary decoder is connected to and sends an enable signal or a disable signal to each of the plurality of SD cards.

2. The apparatus of claim 1, further comprising a directional module, coupled to the internal bus, to sense and collect directional data regarding conditions and direction of the drill string.

3. The apparatus of claim 2, wherein the directional module includes one or more directional sensors, one or more accelerometers, one or more magnetometers, and one or more temperature sensors.

4. The apparatus of claim 1, wherein the master board MCU sends commands to the plurality of sensor boards to command the plurality of sensor boards to sense data.

5. The apparatus of claim 1, wherein one or more of the plurality of sensor boards periodically output or make available the sensor data on the internal bus.

6. The apparatus of claim 1, wherein one or more of the plurality of sensor boards output or make available the sensor data on the internal bus in response to a request from the central storage unit MCU or the master board MCU.

7. The apparatus of claim 1, wherein the central storage unit further comprises a bus adapter coupling the internal bus to the central storage unit MCU.

8. The apparatus of claim 7, wherein:

each SD card is assigned to one of the plurality of sensor boards; and each SD card stores the sensor data from the one assigned sensor board.

9. A measurement-while-drilling (MWD) system for a drill string of an oil drilling system, the MWD system comprising:

a master board including a master board micro controller unit (MCU);

a plurality of sensor boards to sense and collect sensor data;

a central storage unit, including a central storage unit MCU, to store the sensor data collected by the plurality of sensor boards; and an internal bus coupled to the master board, the plurality of sensor boards, and the central storage unit to carry the sensor data from the plurality of sensor boards to the central storage unit for storage by the central storage unit, wherein the central storage unit is removable from the MWD system, wherein the central storage unit comprises a secure digital (SD) card array comprising a plurality of SD cards, the central storage unit MCU, and a binary decoder, wherein the central storage unit MCU is connected to . . . and is connected to the binary decoder via an identification bit line configured to carry a command to enable or disable the plurality of SD cards, and wherein the binary decoder is connected to and sends an enable signal or a disable signal to each of the plurality of SD cards.

10. The MWD system of claim 9, further comprising a directional module, coupled to the internal bus, to sense and collect directional data regarding conditions and direction of the drill string.

11. The MWD system of claim 10, wherein the directional module includes one or more directional sensors, one or more accelerometers, one or more magnetometers, and one or more temperature sensors.

12. The MWD system of claim 9, wherein the master board MCU sends commands to the plurality of sensor boards to command the plurality of sensor boards to sense data.

13. The MWD system of claim 9, wherein one or more of the plurality of sensor boards periodically output or make available the sensor data on the internal bus.

14. The MWD system of claim 9, wherein one or more of the plurality of sensor boards output or make available the sensor data on the internal bus in response to a request from the central storage unit MCU or the master board MCU.

15. The MWD system of claim 9, wherein the central storage unit further comprises a bus adapter coupling the internal bus to the central storage unit MCU.

16. The MWD system of claim 15, wherein:

each SD card is assigned to one of the plurality of sensor boards; and each SD card stores the sensor data from the one assigned sensor board.

* * * * *